United States Patent [19]

Diener

[11] 4,283,358

[45] Aug. 11, 1981

[54] ROTOR-CARBURETOR HAVING AN IDLING MIXTURE ARRANGEMENT FOR INTERNAL COMBUSTION ENGINES

[75] Inventor: Rudolf Diener, Zurich, Switzerland

[73] Assignee: Autoelektronik AG, Chur, Switzerland

[21] Appl. No.: 169,624

[22] Filed: Jul. 16, 1980

[30] Foreign Application Priority Data

Aug. 2, 1979 [CH] Switzerland ..... 7087/79

[51] Int. Cl.[3] ..... F02M 17/16

[52] U.S. Cl. ..... 261/88

[58] Field of Search ..... 261/88, 89

[56] References Cited

U.S. PATENT DOCUMENTS

| | | | |
|---|---|---|---|
| 2,595,719 | 5/1952 | Snyder | 261/89 |
| 2,664,279 | 12/1953 | Bascle | 261/88 |
| 2,668,698 | 2/1925 | Rollins | 261/88 |
| 2,823,906 | 2/1958 | Gideon | 261/88 |
| 3,991,144 | 11/1976 | Diener | 261/88 |

FOREIGN PATENT DOCUMENTS

| | | | |
|---|---|---|---|
| 606784 | 11/1978 | Switzerland | 261/88 |

*Primary Examiner*—Tim R. Miles

*Attorney, Agent, or Firm*—O'Brien & Marks

[57] ABSTRACT

This rotor-carburetor arrangement with idling mixture formation has a traditional throttle flap (2), a rotor-carburetor (3) and at least one idling duct (20). The rotor-carburetor (3) contains an impeller (9) which drives a rotor (8). The rotor (8) has a fuel outlet bore (17). This nozzle bore (17) in the case of a rotating impeller (9) delivers a fuel quantity which stands in a linear relationship to the impeller rpm. The load-fuel air mixture is so lean that a portion of harmful substances in the exhaust gases is minimum and the CO portion is less than about 0.3%. The idling duct (20) has a pipeshaped inlet (23) which is directed toward the impeller (9) and an inlet opening (24) which lies in the marginal area of the intake duct (1) and close below the impeller. In the case of a closed throttle flap (2), the aspirated air flows through the idling duct (20) and this calls for a higher impeller rpm for the idling air throughput. Because of the higher impeller rpm, an idling mixture enriched with fuel will be obtained. The idling mixture in the exhaust gases may be adjusted with the setscrew (25) to 0.5–0.8% CO, which results in a satisfactory idling.

7 Claims, 3 Drawing Figures

ROTOR-CARBURETOR HAVING AN IDLING MIXTURE ARRANGEMENT FOR INTERNAL COMBUSTION ENGINES

The invention relates to a rotor-carburetor having an idling mixture arrangement for internal combustion engines, with an impeller disposed in the intake duct and put into rotation by the intake stream of air, which impeller drives a rotor in the periphery of which at least one fuel exit nozzle bore has been provided which is connected via a fixed fuel supply line with a fuel chamber in the rotor and which delivers a quantity of fuel being in an essentially linear relationship to the rpm of the impeller, to the sucked air and with a throttle flap disposed in the intake duct downstream from the impeller and serving for the quantitative regulation of the fuel-air mixture.

Such a rotor-carburetor has been known for example from the Swiss Pat. No. 606,784. The fuel delivered in the case of a turning rotor from the nozzle bore is absorbed by an atomizing ring attached to the rotor and is atomized into the smallest droplets via its spraying edge because of the acting centrifugal forces. The spraying edge lies above the vanes of the impeller and the intake air charged with the atomized fuel reaches the throttle flap right through between the vanes of the impeller. The impeller rotates relatively fast, possibly with a few 10,000 rpm in case of full load. The precise dosing of the fuel extending over the entire rpm range of the impeller from idling to full load, the finest atomization over the rotating spray edge and the processing of the fuel-air mixture lead to exhaust gases with few harmful substances in which the portions of CO, CH and also of $NO_x$ may lie way below the customary values. Further advantages of such a carburetor are its simple construction and a lack of any kind of adjusting organs.

Whenever in the case of this carburetor, the nozzle bore is dimensioned for a minimum CO content in the load range, then the idling is unsatisfactory, the idling mixture is too lean with a CO content of 0.3% and less. It turned out that for a satisfactory idling, a richer idling mixture, enriched with fuel, is desired, which produces 0.5-0.8% CO (in the case of downdraft carburetors generally around 2% CO) in the exhaust gases.

Unsatisfactory idling of the internal combustion engine results generally in the case of rotor-carburetors in case of which the fuel is not dosed by the rotor and not by a separate dosing arrangement, as for example, a controlled needle valve, and thus there was no lack of attempts either to arrange such rotor-carburetors for the delivery of an idling mixture enriched with fuel.

From the U.S. Pat. No. 2,668,698 (Rollins) for example, a rotor-carburetor arrangement has been known which is equipped with a separate idling nozzle system similar to that of a traditional downdraft carburetor. In the case of the throttle flap being in idling position, the fuel-air mixture is produced only by the idling jet system and only upon an adjustment of the throttle flap does the fuel allotment take place through the nozzle bores of the rotor.

According to another rotor-carburetor arrangement known from the U.S. Pat. No. 2,823,906 (Gideon), the rpm of the rotor is regulated in dependence on the position of the throttle flap. The impeller rotates in an intake cylinder which is surrounded by an annular intake chamber. The intake chamber below the impeller has peripheral openings through which its inner chamber is connected with its outer chamber. The port holes in the intake cylinder are adjustable in their width by way of operating the throttle flap and are closed whenever the throttle flap is in idling position so that all the sucked in air only flows through the intake cylinder and a rich idling mixture with an air-fuel ratio of for example 10:1 is obtained, enriched with fuel as a result of the correspondingly fast rotation of the impeller. In the case of the throttle flap being opened, a part of the sucked in air flows through the annular chamber and passes the impeller, so that the rotor turns more slowly and a leaner fuel-air mixture is obtained with an air-fuel ratio up to 17:1.

Both the separate idling nozzle system with several setscrews as well as the rotor rpm regulation by way of, for example, a mechanical diaphragm coupled with the throttle flap are not only expensive and above all subject to breakdowns, but in certain phases of the operation the idling nozzle system in the idling and the rotor rpm regulation, in case of opened port holes above all in the medium load range, result in a less well processed fuel-air mixture.

A carburetor arrangement of the previously described type is to be created by the invention in case of which an idling fuel-air mixture, enriched with fuel, is to be produced with simple means reliable in operation and favorably priced in comparison with the rotor-carburetor and a uniformly well processed fuel-air mixture is assured in all phases of operation of the internal combustion engine.

According to the invention, this will be achieved through the fact that at least one idling duct is available on the intake duct bridging the throttle flap in the closing position which idling duct leads into the intake duct downstream of the throttle flap and upstream of it has a pipeshaped inlet directed toward the impeller, with an inlet aperture lying in the marginal area of the intake duct just right below the rotational surface determined by the lower edges of the vane, in order to enrich the idling mixture with fuel for the idling air throughput by increasing the rpm of the impeller. By drawing off air in the case of a closed throttle valve through the idling duct with the specially developed inlet, the impellers turned more rapidly than in the case of the same air throughput with an air aspiration through some other aperture, as for example, the slightly opened throttle valve, so that because of the higher rpm of the rotor, correspondingly more fuel is delivered to the aspirated quantity of air from the nozzle bore and a richer idling mixture resulting in a higher CO content in the exhaust gases desired for idling, is obtained. Whenever the throttle flap is opened, then the aspirated air flows through the intake duct, the effect of the idling duct increasing the rpm becomes almost zero and the lean load fuel-air mixture is produced for the low content of harmful substances in the exhaust gases. The idling duct only conveys the processed fuel-air mixture and since its provision in the intake pipe does not disturb the processing of the fuel-air mixture by the rotor in any way, the internal combustion engine is supplied with an equally well processed mixture in all phases of operation including idling. The operational safety as well as the financially favorable production of such an idling duct is obvious.

Advantageous further developments of the object of the application are listed in claims 2–7.

In the following, the invention will be explained in more detail on the basis of a preferred embodiment and with reference to the attached drawing.

Figure 1:
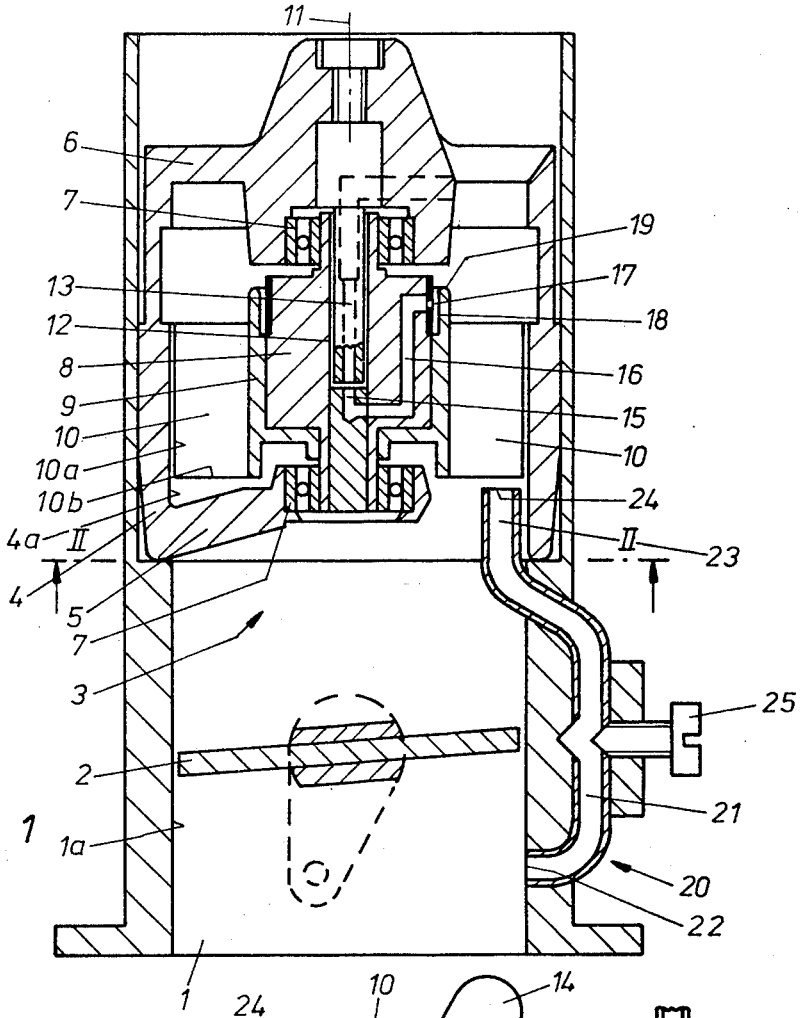
FIG. 1 shows a longitudinal cut through a rotor-carburetor arrangement according to the invention.

The carburetor arrangement shown comprises the traditional throttle flap 2 disposed in the intake duct 1 of an internal combustion engine which is mechanically coupled for operation with the gas pedal, a rotor-carburetor 3 held in a firm position in relation to the throttle flap 2 in the intake duct 1 and an adjustable idling duct 20 firmly disposed on the intake duct 1.

The throttle flap 2 and its operating mechanism are of the customary construction, no changes are either required or provided. The throttle flap 2 may be adjusted to any arbitrary position between the rest position shown in FIG. 1 in which the intake duct 1 is practically closed and a terminal position for a maximally open intake duct 1. The rest position is the idling position of the throttle flap. In order to obtain the desired vacuum in the intake duct 1 below the throttle flap 2, in the case of idling of the internal combustion engine, the throttle flap 2 is adjustable from the outside by means of a set-screw for the idling position which is correct for this purpose.

The rotor-carburetor 3 used in this case has been exhaustively described in principle for example in the Swiss Pat. No. 606,784. A bush 4 which is essentially cylindrical and fitting into the intake duct 1 has at both of its ends always several radial struts 5, 6 which hold two ball bearings 7, coaxial to the axis of the bush. In the ball bearing 7 a rotor 8 has been mounted on which an impeller 9 has been attached with several vanes 10. The outside edges 10*a* of the vanes 10 are at a small distance in the order of magnitude of tenth of millimeters from the inside wall 4*a* of the bush 4. The lower edges 10*b* of the vanes 10 lie in a plane perpendicular to the rotational axis 11. The rotor 8 has a cylindrical bore 12 which is coaxial with the rotational axis 11 and into which a fuel supply tube 13 held firmly by way of the upper struts 6 in the bush 4 projects. One of the upper radial struts 6 is hollow and connects the upper end of the fuel supply 13 with the connecting part 14 (FIG. 2), which is connected with the fuel supply, for example a float. Just below the fuel supply tube 13, the rotor 8 has a cylindrical fuel chamber 15 which is connected by a connecting channel 16 in the rotor periphery. The upper end of the impeller 9 is developed annularly and has an inside wall 18 which is opposite the nozzle bore 17 at a certain distance and terminates above the nozzle bore 17 in a spray edge 19, so that the fuel delivered by the nozzle bore 17 is received by the annular inside wall 18 and is atomized into the smallest droplets via the spray edge 19 whenever the rotor rotates.

In the stationary operating condition the rpm of the impeller, in case of such a rotor-carburetor, is directly proportional to the sucked in quantity of air and the quantity of fuel delivered by the nozzle bore 18 is directly proportional to the rpm of the impeller, so that the rotor-carburetor by itself delivers a fuel-air mixture in which the quantity of fuel for all occuring impeller rpms, beginning from a minimum rpm, is in a linear constant relationship to the quantity of air. The rotor-carburetor is dimensioned such that it produces a fuel-air mixture in the case of which the components of harmful substances, especially of CO and CH in the exhaust gases, are as low as possible and the fuel-air mixture therefore is lean. This fuel-air mixture is called briefly "load mixture" in the following paragraphs. The richer idling mixture enriched by fuel as compared to the former is obtained with the help of the idling duct 20.

The idling duct 20 is shown in FIG. 1 as consisting of a pipe with three curves which may be composed of several pieces for an easier attachment to the intake duct 1. The idling duct 20 bridges the throttle flap 2 in the closing or idling position and in the embodiment shown by way of example, it has a straight, middle part 21 parallel to the rotational axis 11 of the rotor, which middle part is disposed on the outside wall of the intake duct 1. On the middle part 21 of the idling duct, a set-screw 25 operable from the outside has been provided with which the throughput cross section of the idling duct may be adjusted. Downstream from the throttle flap 2, the idling duct 20 leads in an arc to an outlet opening 22 which lies in the inside wall 1*a* of the intake duct 1 at a distance from the closed throttle flap 2 comparable, for example, with the radius of the throttle flap. Upstream from the throttle flap 2, the idling duct 20 leads in two curves to a straight inlet part 23 which fits against the inside wall 1*a* of the intake duct 1 or against the inside wall 4*a* of the rotor bush 4 and is aligned running in parallel to the rotational axis 11 of the rotor. The intake opening 24 of the idling duct 20 lies just below the vanes 10 of the impeller 9 and preferably in a plane perpendicular to the rotational axis 11. The idling duct 20 causes the impeller 9 for the same air throughput to rotate more quickly in the idling position of the throttle flap 2 and thus more fuel is delivered to the aspirated air from the nozzle bore 17. For this action the idling duct 20, increasing the rpm of the impeller, the pipeshaped development of the inlet as well as the position of inlet opening 24 are of significance, by way of which a directed, more rapid flow of air is obtained for the impeller. Important is that the inlet port 24 lies as close as possible to the inside wall of the intake duct 1 or close to the outside edge 10*a* of the vanes 10 and not far away from the lower edge 10*b* of the vanes, and that the pipeshaped inlet 23 is directed in the direction of the impeller. In case of the position of the inlet port 24 shown in FIG. 1, the pipeshaped inlet 24 might also be directed slanting upwards toward the rotational axis instead of in parallel to the rotational axis 11.

The diameter of the idling duct, the length of the inlet port 23, its alignment in the direction of the impeller as well the position and alignment of the inlet port 24 with reference to the impeller depend more or less on the pertinent development of the impeller 10 and of the bush 4 as well as on the idling conditions of the pertinent internal combustion engine. For a given carburetor arrangement, the most favorable development of the idling duct, especially of the inlet part of it, will be found effectively by way of experiment. However, it turned out that a fully satisfying idling duct is sufficiently capable of variations so that for a predetermined rotor-carburetor, especially for a predetermined bush 4 and a predetermined intake duct 1, a cost-favorable development of the idling duct for both production and insertion may be selected. The costs for such an idling duct, as compared to those for a rotor-carburetor, are only minimal and essentially lower than those of the previously known idling arrangements in the case of rotor-carburetors.

In the case of a tested experimental model, the idling duct developed essentially as in FIG. 1 for an inside diameter of about 3 mm and the distance of the intake opening 24 from the lower edge 10*b* of the vane amounted to about 1 mm. An idling mixture could be adjusted with a setscrew 25 in the case of which the CO portion in the exhaust gases lay between 0.3 and 1.5%. It was possible to adjust the idling rpm of the engine to any arbitrary value between 800 and 1100 rpm, whereby the engine ran "smoothly" and without misfiring at any rpm.

In the case of a rotor-carburetor of the described type, no noteworthy differences result between the separate pieces of a carburetor type with regard to dosing of fuel and processing of the mixture. The idling duct 20 may be conceived without difficulty in such a way that tolerance conditional on finishing will have practically no influence on the formation of the idling mixture. Whenever the separate pieces of an internal combustion engine type require approximately the same idling mixture for an optimum idling, there exists therefore the possibility of providing a uniform idling duct without setscrew for a type of an internal combustion engine. The carburetor arrangement in that case has no adjusting organ at all. The setscrew 25 of the idling duct 20 is thus not absolutely necessary, but will be effective because of the spread in the case of single pieces of a type of internal combustion engine for the achievement of an optimum idling.

Figure 2:
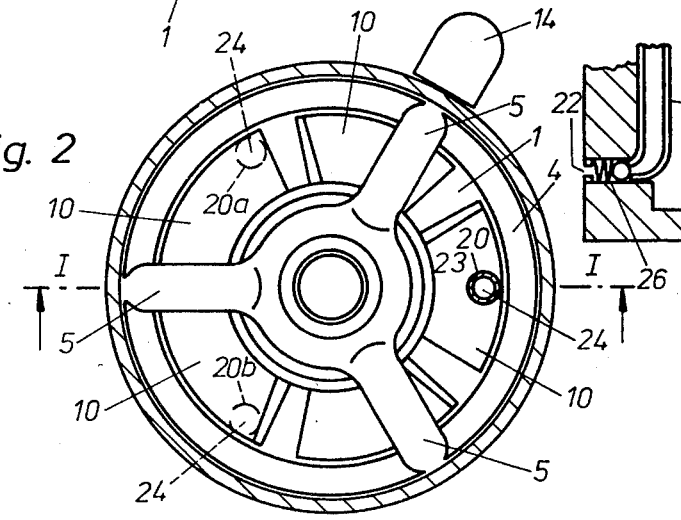
FIG. 2 shows a cross-section of said arrangment along the line II—II in FIG. 1

If it is desired to a act upon the impeller 9 more uniformly in the idling with the accelerated flow of air, then instead of only one idling duct, several of them are provided, especially two idling ducts diametrically opposed to one another, or as drawn with broken lines in FIG. 2, three idling ducts 20, 20*a*, 20*b* divided uniformly over the periphery of the intake duct. Several idling ducts however are generally of advantage only, whenever the individual engines of the type of an internal combustion engine will require the same or approximately the same idling mixture for an optimum idling, since in that case, possibly only one idling duct is to be equipped with a setscrew.

Figure 3:
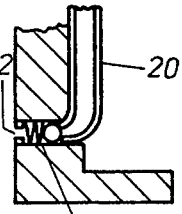
FIG. 3 shows the area of the mouth of an idling duct with ball valve.

In the case of the embodiment shown in FIG. 3, a ball valve 26 is disposed in the idling duct 20 in the area of the mouth into the intake duct 1, by which the idling duct 20 is locked, whenever the throttle flap 2 is shifted from its idling position and whenever downstream of throttle flap, a smaller underpressure prevails than in the case of a closed flap so that it will be guaranteed that the higher impeller rpm exists only in case of the idling.

Inasmuch as the present invention is subject to many variations, modifications and changes in detail, it is intended that all matter contained in the foregoing description or shown in the accompanying drawing, shall be interpreted as illustrative and not in a limiting sense.

What is claimed is:

1. A rotor-carburetor having an idling mixture arrangement for internal combustion engines with an impeller disposed in the suction port and put into rotation by the stream of intake air, which drives a rotor in the periphery of which at least one fuel outlet nozzle bore is provided which is connected with a fuel chamber in the rotor fed via a fixed fuel supply line with fuel and which delivers a quantity of fuel into the sucked in air being in an essentially linear relationship to the rpm of the impeller and with a throttle flap disposed in the suction port downstream from the impeller and serving for the regulation of quantities of the fuel mixture, characterized in that in the suction port (1), there is at least one idling duct (20) bridging the throttle flap (2) in a closing position, which meets the suction port (1) downstream from the throttle flap (2) and upstream from said suction port has a pipeshaped inlet (23) directed toward the impeller (9), with an inlet opening (24) lying in the marginal area of the inlet port (1) closely below the rotational surfaces determined by the lower edges of the impeller (10*b*), in order to enrich the idling mixture with fuel by increase of the rpm of the impeller for the idling throughput of air.

2. A rotor-carburetor as claimed in claim 1, characterized in that there is one single idling duct (20) on the suction port (1).

3. A rotor-carburetor as claimed in claim 1, characterized in that on the suction port (1) there are several idling ducts (20, 20*a*, 20*b*), especially two idling ducts being diametrically opposed to one another or three distributed uniformly over the periphery of the intake port (1).

4. A rotor-carburetor as claimed in one of the preceding claims, characterized in that the idling duct-inlet opening or inlet openings (24) lies or lie in a vertical plane in relation to the rotational axis (11) of the impeller.

5. A rotor-carburetor as claimed in one of the preceding claims, characterized in that in the case of the idling duct (20) or the idling ducts (20, 20*a*, 20*b*) the pipeshaped inlet (23) fits against the wall of the suction duct (1*b*, 4*a*) and is aligned in parallel to the rotational axis (11) of the impeller.

6. A rotor-carburetor as claimed in one of the preceding claims, characterized in that the idling duct (20) or at least one idling duct has a setscrew (25) operable outside of the intake duct (1) for changing the throughput cross section.

7. A rotor-carburetor as claimed in one of the preceding claims, characterized in that the one or everyone of the idling ducts (20) contains a ball valve (26) in the area of the port into the intake duct (1), which is in order to close the idling duct (20) in the case of an underpressure in the intake duct (1) which is smaller than the idling underpressure.

* * * * *